US007957839B2

(12) United States Patent
Takach et al.

(10) Patent No.: US 7,957,839 B2
(45) Date of Patent: Jun. 7, 2011

(54) HVAC ZONE CONTROLLER

(75) Inventors: Eugene J. Takach, Eden Prairie, MN (US); Paul G. Schwendinger, St. Louis Park, MN (US); David P. Mulhouse, Minnetonka, MN (US); Christian Richard Trifilio, St. Paul, MN (US); Ronaldo Fernandez Carreon, Minneapolis, MN (US); Daniel Vincent Clements, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 689 days.

(21) Appl. No.: 11/618,378

(22) Filed: Dec. 29, 2006

(65) Prior Publication Data

US 2008/0161977 A1 Jul. 3, 2008

(51) Int. Cl.

| | |
|---|---|
| ***G05B 11/01*** | (2006.01) |
| ***G05B 15/00*** | (2006.01) |
| ***G05D 23/00*** | (2006.01) |
| ***F24F 7/00*** | (2006.01) |
| ***H05K 7/20*** | (2006.01) |
| ***H05K 1/14*** | (2006.01) |
| ***H05K 7/00*** | (2006.01) |
| ***H05K 1/00*** | (2006.01) |

(52) U.S. Cl. ..... 700/276; 700/17; 700/83; 700/277; 236/49.3; 361/720; 361/736; 361/748; 361/760

(58) Field of Classification Search ..... 700/277, 700/17, 83, 276; D13/152, 162; 236/49.3; 361/720, 736, 748, 760; 439/76.1, 76.2, 439/709

See application file for complete search history.

(56) References Cited

U.S. PATENT DOCUMENTS

| | | | | |
|---|---|---|---|---|
| 3,664,414 | A | 5/1972 | Raleigh | |
| 3,892,104 | A | 7/1975 | Klee et al. | |
| 4,071,745 | A * | 1/1978 | Hall | 700/16 |
| 4,205,381 | A * | 5/1980 | Games et al. | 700/277 |

(Continued)

FOREIGN PATENT DOCUMENTS

| | | |
|---|---|---|
| SL | 20556 | 10/2001 |

OTHER PUBLICATIONS

"Zonefirst—Masterzone Heat Pump Zoning System—Model MMH3", (unknown).

(Continued)

*Primary Examiner* — Ramesh B Patel
*Assistant Examiner* — Jennifer L. Norton
(74) *Attorney, Agent, or Firm* — Seager Tufte & Wickhem LLC

(57) ABSTRACT

A zone controller having an electronic board with a plurality of electronic components attached thereto. The electronic components are constructed and arranged to receive a plurality of signals from a plurality of thermostats and to transmit a plurality of signals to a plurality of air control devices for controlling airflow in ducts. The electronic components include a first grouping of electronic components that are not accessed to perform either installation or operation functions, a second grouping of electronic components that are accessed to perform installation functions, and a third grouping of electronic components that are only accessed to perform operation functions. A first cover is provided that covers and prevents access to the first grouping of electronic components. A second cover is provided that selectively covers and prevents access to the second grouping of electrical components but not the third grouping of electrical components.

21 Claims, 9 Drawing Sheets

U.S. PATENT DOCUMENTS 4,308,953 A * 1/1982 Cohen ..... 206/708
4,335,320 A * 6/1982 Garver ..... 307/39
4,338,791 A 7/1982 Stamp, Jr. et al.
4,495,986 A 1/1985 Clark et al.
4,501,125 A 2/1985 Han
4,530,395 A 7/1985 Parker et al.
4,795,088 A 1/1989 Kobayashi et al.
4,830,095 A * 5/1989 Friend ..... 165/208
4,843,084 A * 6/1989 Parker et al. ..... 700/277
4,932,466 A 6/1990 Foster
5,024,265 A 6/1991 Buchholz et al.
D319,429 S * 8/1991 D'Aleo et al. ..... D13/162
5,042,265 A 8/1991 Baldwin et al.
5,092,394 A 3/1992 Foster
5,129,234 A 7/1992 Alford
D329,226 S * 9/1992 Holbrook ..... D13/162
5,161,608 A * 11/1992 Osheroff ..... 165/208
5,245,835 A 9/1993 Cohen et al.
5,303,767 A 4/1994 Riley et al.
5,318,104 A 6/1994 Shah et al.
5,344,069 A 9/1994 Narikiyo
5,348,078 A * 9/1994 Dushane et al. ..... 165/209
5,449,319 A 9/1995 Dushane et al.
5,495,887 A * 3/1996 Kathnelson et al. ..... 165/11.1
5,751,572 A 5/1998 Maciulewicz
5,818,194 A 10/1998 Nordby
5,829,674 A 11/1998 Vanostrand et al.
5,860,473 A * 1/1999 Seiden ..... 165/208
5,944,098 A 8/1999 Jackson
5,983,890 A 11/1999 Thomas et al.
6,196,467 B1 3/2001 Dushane et al.
D449,279 S 10/2001 Takach, Jr. et al.
D454,544 S * 3/2002 Takach et al. ..... D13/152
6,402,043 B1 * 6/2002 Cockerill ..... 236/78 D
6,540,148 B1 4/2003 Salsbury et al.
6,574,581 B1 6/2003 Bohrer et al.
6,705,533 B2 3/2004 Casey et al.
6,711,471 B2 3/2004 Kidder
6,725,914 B2 4/2004 Petterson
6,757,589 B1 * 6/2004 Parker et al. ..... 700/282
6,775,593 B1 * 8/2004 Parker et al. ..... 700/282
6,851,621 B1 2/2005 Wacker et al.
6,856,841 B2 2/2005 Peterson
6,874,693 B2 4/2005 Readio
6,879,881 B1 4/2005 Attridge, Jr.
6,964,174 B2 11/2005 Shah
6,967,565 B2 11/2005 Lingemann
6,986,708 B2 * 1/2006 Demster ..... 454/248
6,990,393 B2 * 1/2006 Parker ..... 700/282
6,997,390 B2 2/2006 Alles
7,000,849 B2 2/2006 Ashworth et al.
7,017,827 B2 3/2006 Shah et al.
7,047,092 B2 5/2006 Wimsatt
7,055,759 B2 6/2006 Wacker et al.
7,106,019 B2 9/2006 Becerra et al.
7,114,554 B2 10/2006 Bergman et al.
7,130,719 B2 10/2006 Ehlers et al.
7,150,408 B2 12/2006 DeLuca
7,156,316 B2 1/2007 Kates
7,188,002 B2 3/2007 Chapman, Jr. et al.
7,228,693 B2 6/2007 Helt
7,272,452 B2 * 9/2007 Coogan et al. ..... 700/19
7,320,362 B2 1/2008 Nichols
7,360,370 B2 * 4/2008 Shah et al. ..... 62/131
7,396,254 B2 * 7/2008 Harmelink et al. ..... 439/540.1
7,419,406 B2 * 9/2008 Brochu et al. ..... 439/677
D590,352 S * 4/2009 Jacoby et al. ..... D13/164
7,558,648 B2 * 7/2009 Hoglund et al. ..... 700/277
7,645,158 B2 * 1/2010 Mulhouse et al. ..... 439/441
7,755,908 B2 * 7/2010 Sasaki et al. ..... 361/752
7,758,353 B2 * 7/2010 Lee et al. ..... 439/76.1
7,766,246 B2 * 8/2010 Mulhouse et al. ..... 236/49.3
2003/0103075 A1 6/2003 Rosselot
2003/0124884 A1 * 7/2003 Katsumata et al. ..... 439/76.2
2003/0134528 A1 * 7/2003 Tanaka et al. ..... 439/76.2
2004/0194484 A1 10/2004 Zou et al.
2004/0262410 A1 12/2004 Hull
2005/0040248 A1 2/2005 Wacker et al.
2005/0043907 A1 * 2/2005 Eckel et al. ..... 702/62
2005/0156049 A1 7/2005 Van Ostrand et al.
2005/0159847 A1 7/2005 Shah et al.
2005/0159924 A1 7/2005 Shah et al.
2005/0228607 A1 10/2005 Simons
2005/0288824 A1 12/2005 Fisher
2006/0004492 A1 1/2006 Terlson et al.
2007/0045429 A1 3/2007 Chapman, Jr. et al.
2007/0050732 A1 3/2007 Chapman, Jr. et al.
2007/0057075 A1 3/2007 Votaw et al.
2007/0220907 A1 * 9/2007 Ehlers ..... 62/126
2007/0225868 A1 9/2007 Terlson et al.
2008/0223943 A1 * 9/2008 Mulhouse et al. ..... 236/49.3

OTHER PUBLICATIONS

"Jackson Systems—Residential and Light Commericial Zone Control (Z-600) Two Position", www.jacksonsystems.com, (Unknown).
"EWC Controls Inc—Technical Bulletin Model UZC4 Zone Control", (Dec. 12, 2005),1-24.
Drew, Jerry C., "XCI—Proper Staging Techniques for Multi-Stage Thermostats", *Home Toys Article*—www.hometoys.com, (Dec. 2002),1-4.
"HVAC Talk", www.HVAC-talk.com, (Nov. 17, 2006).
"Newest Product—UZC4", www.ewccontrols.com, (Oct. 20, 2005).
"ABB Brochure, To Measure is to Know, DIN Rail Mounted Electricity Meters", (Jan. 2006).
"Enclosures and Cable Systems Overview", ABB, (Nov. 2002).
"Comfort System Z-600 Zone Control", Jackson Systems, LLC www.jacksonsystems.com.(at least as early as Dec. 29, 2006).
"DIGI3U", Zonex Systems 3-Zone Universal Controller for G/E or Heat Pump Applications www.xonexsystems.com,(at least as early as Nov. 2, 2006).
"DuroZone ED3 Zoning Panel", www.durodyne.com,(2004).
"Electronic Controls—Zone Control Family", *Taco Catalog #100-5,0*, Taco Hydronic Components & Systems www.taco-hvac.com,(Sep. 1, 2003).
"EMM-3 Electronic MiniZone Panel", *68-3041-2 G.H. Rev. 10-02*, Honeywell www.honeywell.com/yourhome,(Oct. 2002).
"EMM-3U Universal Electronic MiniZone Panel", *68-0237-2 G.H. Rev. 11-02*, Honeywell www.honeywell.com/yourhome,(Nov. 2002).
"Homeowner's Manual—Harmony III Zone Control System", Controls 505,024M /01/05, (Jan. 2005).
"Installation, Start-Up and Configuration Instructions", *Catalog No. 533-30011*, Carrier 3Vtm Control System/VVT Zone Controller/Pressure Dependent Control Part No. 33ZCVVTZC-01,(2004).
"Lennox Harmony III Zoning System", (*83M77*)*HIII 5/05*, www.lennox.com.(2005).
"Mini-Masterzone Zoning System—3 Zones", *Form 2233-060321*, Zonefirst MMZ3 Installation and Operating Instructions www.zonefirst.com,(2003).
"Owner's Manual", Aprilaire—Model 6504 www.aprilaire.com,(at least as early as Nov. 2, 2006).
"Product Catalog", Arzel Zoning Technology, Inc. www.arzelzoning.com,(2006).
"QO Load Centers and Circuit Breakers", *Order No. 1130BR0001R4/06*, A brand of Schneider Electric—Square D www.SquareD.com,(2004).
"Siemens 3-144", *CE1N3144en* Feb. 13, 2006, KNX Synco 700 Universal Controllers RMUZ Building Technologies, HVAC Products Universal controllers RMU710, RMU720, RMU730.
"SlimZone Premier Zone Control Panel", Robertshaw Climate Controls Americas www.icca.invensys.com,(2004).
"SmartZone System Manual", *P/N 220022-02*, CI Controls www.xcicontrols.com, (Oct. 3, 2005).
"Technical Bulletin", EWC Controls, Inc. TB-206—Model NCM 300 Zone Control System www.ewccontrols.com,(2000).
"Tracker—Tracker Version 12—Building Automation System", *BAS-PRC010-EN File No. PL-ES-BAS-000-PRC010-0503*, Trane www.trane.com,(May 2003).
"TZ-4 TotalZone Zone Control Panel", *68-0259-1 G.H. Rev. 12-02*, Honeywell www.honeywell.com/yourhome,(Dec. 2002).

"WR—CZ-4 Master Control Panel", www.white-rodgers.com,(at least as early as Dec. 29, 2006).
http://www.appliancemagazine.com/printphp?article=1463 &zone=211&first=1, Appliance Magazine.com, "High-Efficiency HVAC Motor," 1 page, Jul. 2006.
http://www.geindustrial.com/cwc/products?pnlid=4&id=ecmph, GE Consumer and Industrial Electrical Distribution, ECM Product Information, 1 page, printed Feb. 28, 2007.
http://www.geindustrial.com/cwc/products?id=ecm&famid=23, GE Consumer and Industrial Electrical Distribution, GE ECM 2.3 Series Product Information, 2 pages, printed Feb. 28, 2007.
http://www.hvac-talk.com/vbb/showthread.php?t=75867 &highlight=DEHUM+zone+control, "Update on 4-Zone Arzel + Tappan Installation," 5 pages, May 2005.
http://www.jacksonsystems.com/index.php?module=z600, Jackson Systems, LLC, "Coming in March, Residential and Light Commercial Zone Control (Z-600) Two Position," 2 pages, at least as early as Feb. 8, 2007.
http://www.lennoxcommercial.com/support/faq.asp?a=a&category2&question=76, Lennox, "What is a Variable Speed Furnace?" 2 pages, 2007.
http://www.weinstall.ca/two_stage_heating.htm, "Clarkson Comfort Zone Two Stage Heating Variable Speed Furnace Systems," 2 pages, printed Jan. 26, 2007.
http://www.westinghousehvac.com/wh92_2stgvarspd.asp, Westinghouse Cooling and Heating, "92.1%* AFUE Two-Stage Variable Speed Gas Furnace," 2 pages, printed Jan. 26, 2007.
ABB Installation Material, 2 pages, prior to Nov. 30, 2006.
Aprilaire, "Intelligent Zoned Comfort Control System," Owners Manual Model 6504, pp. 1-12, prior to Nov. 30, 2006.
Bryant Heating & Cooling Systems, Model 340MAV, 350MAV, 355MAV, Condensing Gas Furnace, User's Information Manual, 2 pages, prior to Nov. 30, 2006.
Bryant, Thermidistat Control,TSTAT Installation and Start-Up Instructions, pp. 1-12, Aug. 1999.
Carrier, 58MVB 4-Way Multipoise Variable-Capacity Condensing Gas Furnace, Installation, Start-Up and Operating Instructions, 2 pages, Aug. 2005.
GE Industrial Systems, "Troubleshooting GE ECM Driven Systems," 2 pages, prior to Nov. 30, 2006.
GE ECM, "The X13 Blower Demo," pp. 1-13, 2006.
Lennox Industries Inc., G61 MPV Series Unit, Installation Instructions, 2 pages, Sep. 2006.
Lennox Industries Inc., Harmony III Zone Control System, Installation Instructions, 30 pages, Jan. 2006.
Robertshaw, "SlimZone Premier Zone Control System," Installation and Operation Manual, pp. 1-32, prior to Nov. 30, 2006.
Schneider Electric, "Square DQO Load Centers and Circuit Breakers, Unsurpassed Circuit Protection and Application Flexibility," 8 pages, 2004.
Trane, "Tracker Version 12 Building Automation System," pp. 1-32, May 2003.
Variable Speed Motor Control Installation Instructions, pp. 1-29, Jul. 2006.
http://www.hvac-talk.com/vbb/printthread.php?t=99837&pp=40, "HVAC-Talk: Heating, Air & Refrigeration Disscussion," 5 pages, on or before Nov. 30, 2006.
http://www.hvac-talk.com/vbb/showthread.php?t=121627 &hightlight=zone+timer, "Multi Stage Control—Zone Board or Tstat," 2 pages, Nov. 17, 2006.

* cited by examiner

HVAC ZONE CONTROLLER

FIELD OF THE INVENTION

The invention relates to heating, ventilation, and air conditioning (HVAC) equipment, and more particularly, to zone controllers for HVAC systems.

BACKGROUND OF THE INVENTION

Many buildings, particularly relatively small buildings such as single-family houses, have a single HVAC unit that is controlled by a single thermostat. The HVAC unit typically comprises some type of fluid temperature modifying device, such as a furnace for heating air, a boiler for heating a liquid or steam, or an air conditioner having an evaporating coil for cooling air. If the fluid is air, it is typically ducted to various locations within the building, or if it is liquid or steam, it is typically piped to heat exchangers at various locations in the building. The thermostat in this type of space conditioning system is typically positioned at a location where the heating and cooling loads are representative of the entire structure. For example, the thermostat may be installed in an interior room away from windows and doors that would tend to influence the sensed temperature. The HVAC equipment then controls the heating and cooling of the entire structure according to the thermostat signal received from the single location.

However, a single thermostat location may not accurately represent the heating or cooling needs throughout the structure. Other locations of the building may have significantly greater or lower heating and cooling loads than exist at the location of the thermostat. For example, rooms having a larger surface area of windows, or rooms having exterior walls, may require greater heat inputs to maintain the desired temperature. Similarly, rooms facing south or west, or rooms that are on an upper story, may require greater cooling inputs to maintain the desired temperature. Where the HVAC equipment is controlled only by a single thermostat, the heating or cooling supplied to each individual area of the building will be based on the heating or cooling needs at the thermostat location and not on the actual heating and cooling needs of each individual area. As a consequence, the heating and cooling loads of individual areas of the structure may not be satisfied and the temperature of these areas will tend to deviate from the desired temperature.

In some situations, it may be desired to control different locations within a building at different temperatures. For example, rooms that are seldom occupied may not need to be maintained at the same temperature as rooms that are frequently occupied. Energy that is used to heat or cool these unoccupied rooms is not used effectively or economically. Also, rooms may be occupied by people having special temperature needs, such as an elderly person or an infant, that are preferably maintained at a different temperature than the rest of the building. However, a system that has only a single thermostat is generally unable to accurately control different locations in the building at different temperatures.

One known solution to this problem is to utilize HVAC zone control. Rather than having a single thermostat controlling the HVAC equipment, multiple thermostats are positioned at locations within the building that are expected to have different heating and cooling loads. Although it is possible that each of these thermostats could control a separate fluid temperature modifying device such as a separate furnace or air conditioner for each zone, such an approach is generally neither efficient nor economical. Rather, most commonly the ductwork or piping that is used to transmit the conditioned fluid to the building spaces is configured with controls to adjust fluid flow. For example, an air duct may be configured with a controllable damper that is capable of opening and closing to control the flow of air to a space within the building. Similarly, piping may be configured with a controllable valve that is capable of opening and closing to control the flow of liquid or steam to a space within the building.

A system having HVAC zone control generally requires the use of a zone controller to receive the signals from the various thermostats, control the operation of the heating or cooling device, and control the distribution of the conditioned fluid through the ductwork or piping. The zone controller typically comprises electronic circuitry for evaluating the heating or cooling needs of the various zones of the building and for determining an appropriate control of the heating or cooling device and the dampers or valves. While this control may be as simple as turning on the heating or cooling device and opening the damper or valve for a particular zone any time the thermostat from that zone calls for space conditioning, often times more complex control strategies are desired. For example, U.S. Pat. No. 5,024,265, incorporated in its entirety herein by reference, describes a zone control system having means for determining the zone of greatest demand and for synchronizing the start of the control signal for other zones to coincide with the start of the control signal for the zone of greatest demand. One advantage of this arrangement is that it may prevent overcycling of the heating or cooling device. Even relatively simple zone control schemes require substantial electronic circuitry to implement. Where more complex control strategies are used, even greater amounts of electronic circuitry are required. Regardless of the zone controller operating strategy used, zone controller electronic circuitry generally require a plurality of electronic components, such as wire receptacles, logic devices, relays, resistors, power supplies, and other electronic components for proper operation. The number of these electronic components tends to increase with increasing functionality and capacity of the zone controller.

There is a need for improved zone controllers.

SUMMARY OF THE INVENTION

The invention relates to an HVAC zoning control panel. The zoning control panel includes an electronic board having a plurality of electrical components attached to the board. The electrical components are constructed and arranged to receive a plurality of signals from a plurality of thermostats and to transmit a plurality of signals to a plurality of air control devices for controlling airflow in ducts. The electrical components include a first grouping of electrical components that includes components that are not accessed to perform either installation or operation functions, a second grouping of electrical components that includes components that are accessed to perform installation functions, and a third grouping of electrical components that includes components that are accessed to perform operation functions. The zoning control panel also includes a first board cover that is configured to prevent access to the first grouping of electrical components, and also a second board cover that is configured to selectively prevent access to the second grouping of electrical components but not the third grouping of electrical components.

Another aspect of the invention relates to an HVAC zoning control panel having a board and a plurality of electronic components attached to the board. The electronic components include components configured to receive a plurality of signals from a plurality of thermostats, components configured to transmit a plurality of signals to a plurality of dampers within air ducts; components configured to transmit signals to a conditioning unit for modifying the temperature of air within air ducts, components configured to provide an interface for selecting operating parameters, components configured to provide an indication of a condition, and a microprocessor configured to control the transmission of signals to the dampers and conditioning unit in response to the signals received from the thermostats and parameters selected through the interface. The electronic components of the HVAC zoning control panel also include a first grouping of electronic components that includes components that are not accessed to perform either installation or operation functions, a second grouping of electronic components that includes components that are accessed to perform installation functions, and a third grouping of electronic components that includes components that are accessed to perform operation functions. The HVAC zoning panel further includes a first board cover that is configured to prevent access to the first grouping of electronic components, and a second board cover that is configured to selectively prevent access to the second grouping of electronic components but not the third grouping of electronic components The invention may be more completely understood by considering the detailed description of various embodiments of the invention that follows in connection with the accompanying drawings.

Figure 1:
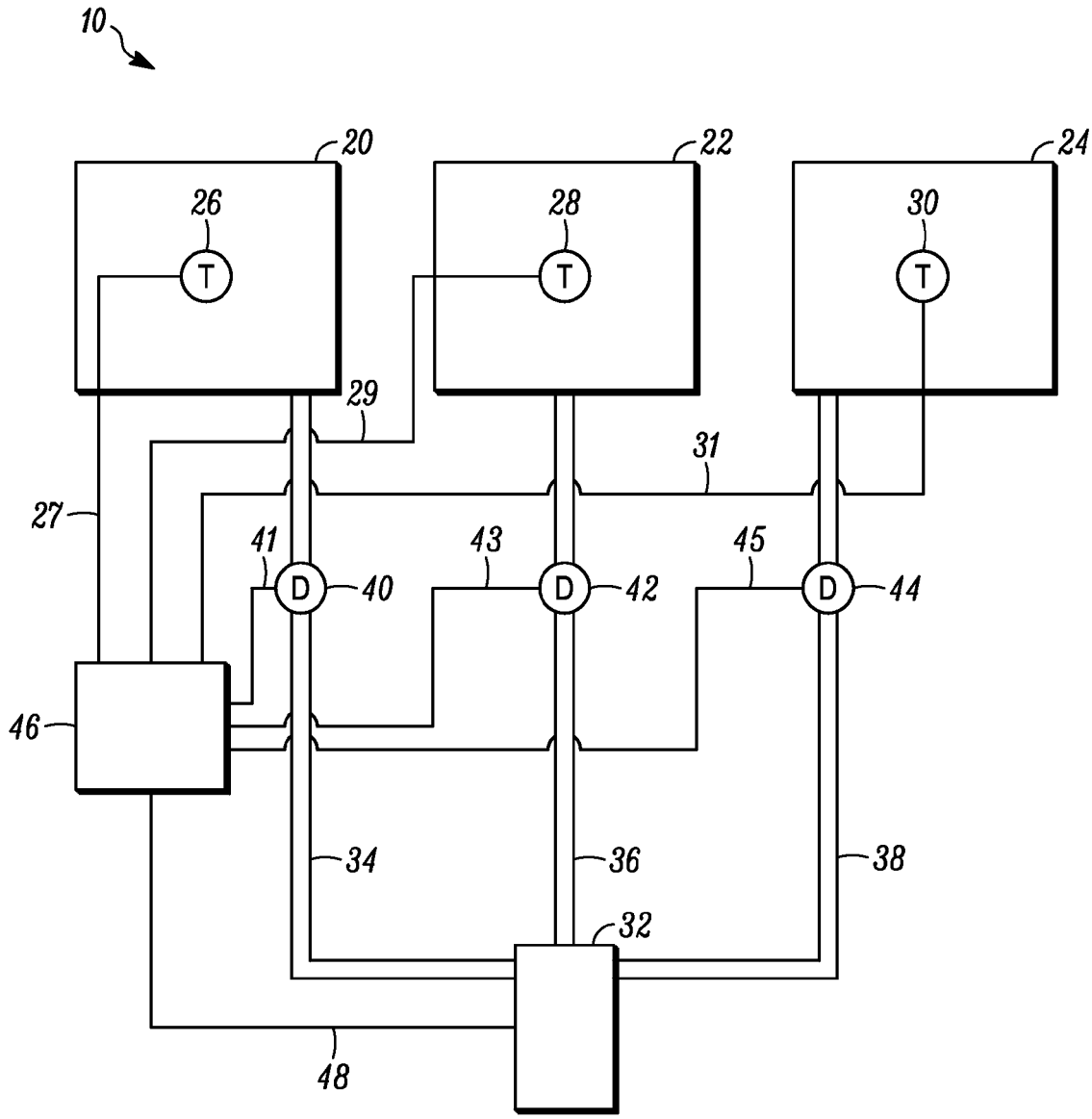
(PRIOR ART) FIG. 1
FIG. 1 is a schematic of an HVAC system having multiple zones (prior art).

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims. In the drawings and in the following description, like numbers will reference like parts.

DETAILED DESCRIPTION OF THE INVENTION

A zone controller must ultimately be installed in a building and operated in order to be useful. However, despite the fact that many installers have training in the installation of HVAC components, the task of installing a zone controller can be difficult. This difficulty is related in part to the complexity of the zone controller itself. Because the configuration of the HVAC equipment can vary considerably from one building to the next, zone controllers are often provided with the capability to adapt to a wide variety of equipment configurations. However, this adaptability often requires that the installer make a number of selections or adjustments to the zone controller itself. The need for adaptability also often increases the complexity of the controller and the number of electronic components that are part of the zone controller. The end result is that the zone controller may have a large number of electronic components, some of which the installer is required to manipulate and some of which are not intended to be manipulated. The complexity of the zone controller may cause the installer to become confused regarding the proper installation procedures, despite having training in the operation and installation of HVAC equipment. This confusion may result in increased installation labor time, and therefore installation cost, or even improper installation and improper operation of the zone controller. Furthermore, there is a risk that some of the electronic components within the zone controller will be inadvertently damaged during the installation due to the fact that the sheer number of electronic components within the zone controller increases the probability of inadvertently making contact with an electronic component and causing damage. Also, the proximity of electronic components that require manipulation to those that do not require manipulation increases the chance that an electronic component will be damaged. There is also a safety risk to the installer if components are exposed within the zone controller that have an electrical potential.

Once a zone controller has been installed and made operational, the homeowner or building occupant may need to interface with it. A zone controller may be configured to provide status information so that an owner or occupant can determine whether the zone controller is working properly. A zone controller may also provide certain functions that are intended to be manipulated by the building owner or occupant. For example, a zone controller may include a switch that is selected when the building is to be unoccupied for an extended period. This switch could be used is to revert to a single thermostat type operating mode, where the entire building is controlled by only a single thermostat. This allows the owner or occupant to set only one thermostat back to an energy saving setting while the building is unoccupied, rather than having to change the settings of all thermostats in the building. However, owners or occupants are often not trained in the operation of complicated HVAC equipment and zone controllers. Particularly where a zone controller has a large number of electronic components, a building owner or occupant may be confused by the complexity of electronic components within the zone controller and may not accomplish their desired task or may inadvertently change a setting of the zone controller that will negatively affect its performance.

FIG. 1 is a schematic of a typical HVAC system 10 having a multiple zones. The embodiment of FIG. 1 is shown as having three zones. However, other embodiments having fewer or greater numbers of zones are usable. Zones 20, 22, 24 are separate areas of a building. Each zone 20, 22, 24 includes a thermostat 26, 28, 30, respectively. A conditioning unit 32 is provided for increasing or decreasing the temperature of a fluid, such as air. For example, conditioning unit 32 may be a furnace that increases the temperature of air. In the case where conditioning unit 32 is a furnace, heated air is transmitted through ducts 34, 36, 38 to each of zones 20, 22, 24, respectively. Each duct 34, 36, 38 includes a damper 40, 42, 44, respectively, for controlling the flow of air through ducts 34, 36, 38. Zone controller 46 is configured to receive signals from each of thermostats 26, 28, 30, through cables 27, 29, 31, respectively. Zone controller 46 is also configured to transmit control signals to each of dampers 40, 42, 44, through cables 41, 43, 45. Zone controller 46 is further configured to transmit control signals to conditioning unit 32 through cable 48.

Alternatively, conditioning unit 32 may be a boiler that increases the temperature of a liquid or steam. In this case, fluid is transmitted through piping 34, 36, 38, where the flow of fluid is controlled by valves 40, 42, 44. The principles of operation discussed herein are equally applicable to an air-based system or a liquid- or steam-based system. For ease of description, we will describe the invention with respect to an air-based system, however, it should be understood that all descriptions are equally applicable to a liquid- or steam-based system.

A variety of control strategies for zone controller 46 are usable. In general, however, zone controller 46 is configured to open and close dampers 40, 42, 44, in response to signals from thermostats 26, 28, 30, respectively, and to operate conditioning unit 32. For example, if zone controller 46 senses that thermostat 26 is calling for heat because the temperature in zone 20 has fallen below a preset level, then zone controller 46 signals conditioning unit 32 to turn on and signals damper 40 to be in an open position. Heated air from conditioning unit 32 will then travel through duct 34, through damper 40, and into zone 20, thereby tending to increase the temperature within zone 20. If at the same time thermostats 28, 30 in zones 22, 24 do not call for heat, dampers 42, 44 will be closed and heated air will not travel through ducts 36, 38 into zones 22, 24. The operation of HVAC system 10 in response to other thermostat signals from other zones and other combinations of zones is similar. HVAC system 10 may include other sensing devices and other sources of input to zone controller 46, as well as other actuating devices and other device that are controlled by zone controller 46.

Figure 2:
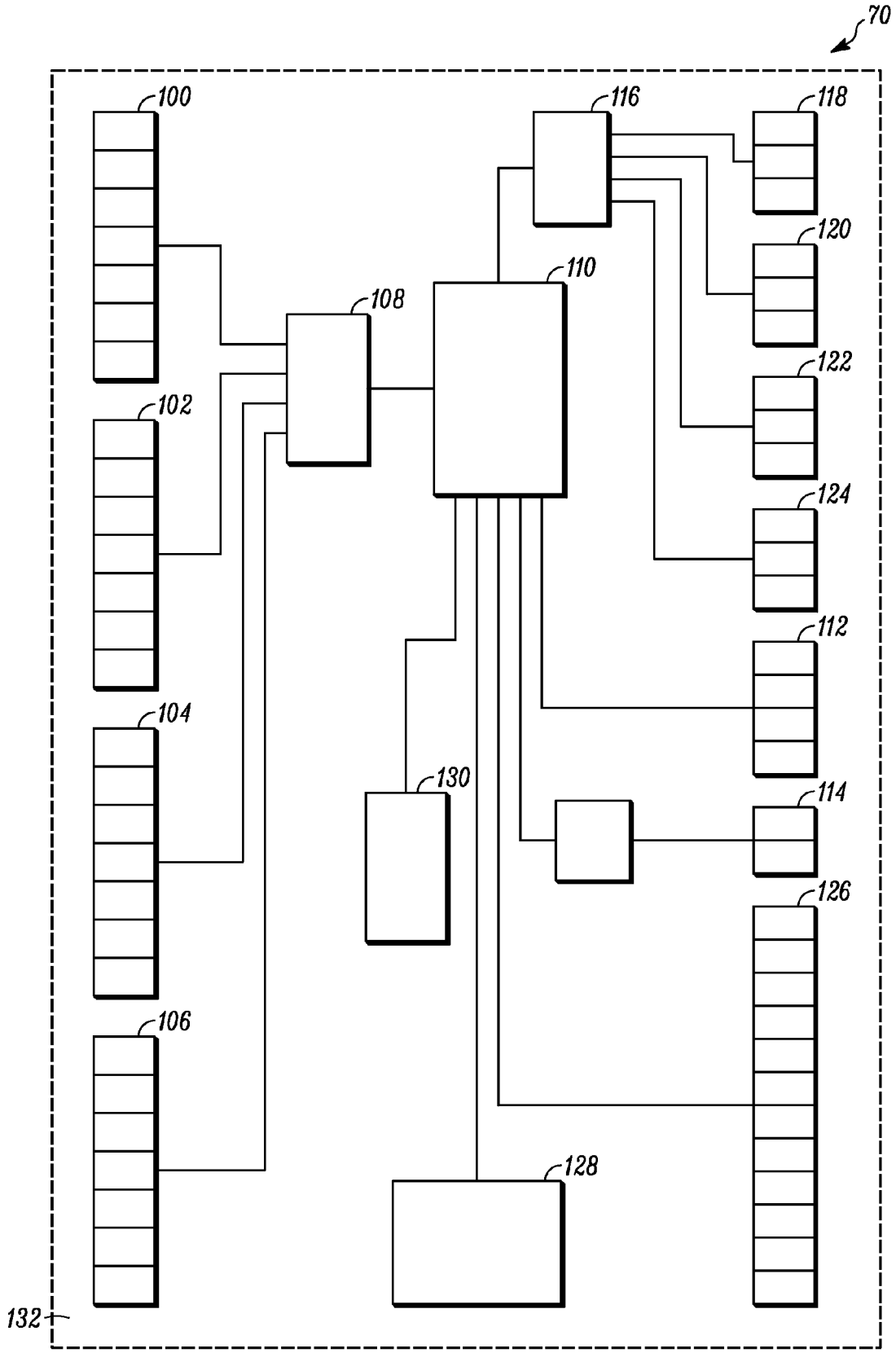
FIG. 2 is a schematic of the electronic components of a zone controller.

A schematic of electronic components of one embodiment of a zone controller 70 is shown in FIG. 2. Zone controller 70 is configured for use with the present invention. However, many other embodiments and configurations of zone controller 70 are usable with the present invention. The zone controller 70 of FIG. 2 is configured for use with four zones. However, other configurations for other numbers of zones are usable. Zone controller 70 of FIG. 2 includes four thermostat terminals 100, 102, 104, 106. Each thermostat terminal 100, 102, 104, 106 is configured to receive wires from a thermostat. The number of wires depends on the thermostat and HVAC equipment that the zone controller is intended to be used with. The operation and characteristics of thermostats are known to those of skill in the art. In one embodiment, each thermostat has wires for connecting to a power supply transformer, calling for first stage heating, calling for second stage heating, calling for third stage heating, calling for first stage cooling, calling for second stage cooling, calling for fan power, calling for supplemental heating, and calling for actuating a changeover valve in a heat pump. Other thermostat embodiments are usable, having various subsets of these wires or additional wires. The thermostat terminals 100, 102, 104, 106 are configured to receive each of the thermostat wires that are present. The installer brings the wires from each thermostat to the zoning panel and connects each wire to the corresponding connection terminal.

Signals received at thermostat terminals 100, 102, 104, 106 are transmitted to an input processing component 108 and further to a microprocessor 110. Microprocessor 110 is configured to receive signals from sensor terminal 112. Sensor terminal 112 may be configured to receive signals from sensors such as an outdoor air temperature sensor and a discharge air temperature sensor. Other sensors are usable. The nature and construction of these sensors are known to those of skill in the art. A power input 114 is provided for connection to a power supply transformer. Microprocessor 110 is further configured to transmit signals to a driver 116, which in turn transmits signals to a plurality of damper terminals 118, 120, 122, 124. Each of damper terminals 118, 120, 122, 124 is configured to receive wires that are used to transmit a signal to a damper to control the position of the damper. Microprocessor 110 is also configured to transmit signals to an equipment terminal 126. Equipment terminal 126 is configured to receive wires that are used to transmit signals to HVAC equipment, such as a furnace, boiler, air conditioner, or heat pump, to control the operation of the HVAC equipment. An interface 128 is provided that is in communication with microprocessor 110 and is used to input various parameters and make various selections to affect the operation of the zone controller 70. Interface 128 may take a number of forms, such as a plurality of dip switches, dials, and potentiometers and other electronic components, an LCD screen and buttons, or a plurality of film-style switches. Interface 128 is particularly adapted for use during the installation process in order to configure the zone controller 70 to operate properly with the specific HVAC equipment that is present. Operation module 130 is intended for use during the operation of the zone controller 70 for determining the status of the zone controller 70 and for providing operation inputs. For example, operation module 130 may be configured to provide indicator lights that indicate the status of an aspect of zone controller 70, and may be configured to provide switches for setting a mode of operation. Operation module 130 is in communication with microprocessor 110. Each of the electrical components of zone controller 46 is attached to an electronic board 132.

As stated above, it is desired that the zone controller 70 be configured to allow the installer to make the necessary electrical connections and settings so that the zone controller will function properly in the particular application in which it is being used. The zone controller is also desirably configured to minimize the confusion of the installer that is possible with the large number of electrical components being present within the zone controller. It is also desired that any functions or interfaces directed toward the building owner or occupant also be presented in a manner that prevents confusion and prevents inappropriate modification of the settings of the zone controller.

Figure 3:
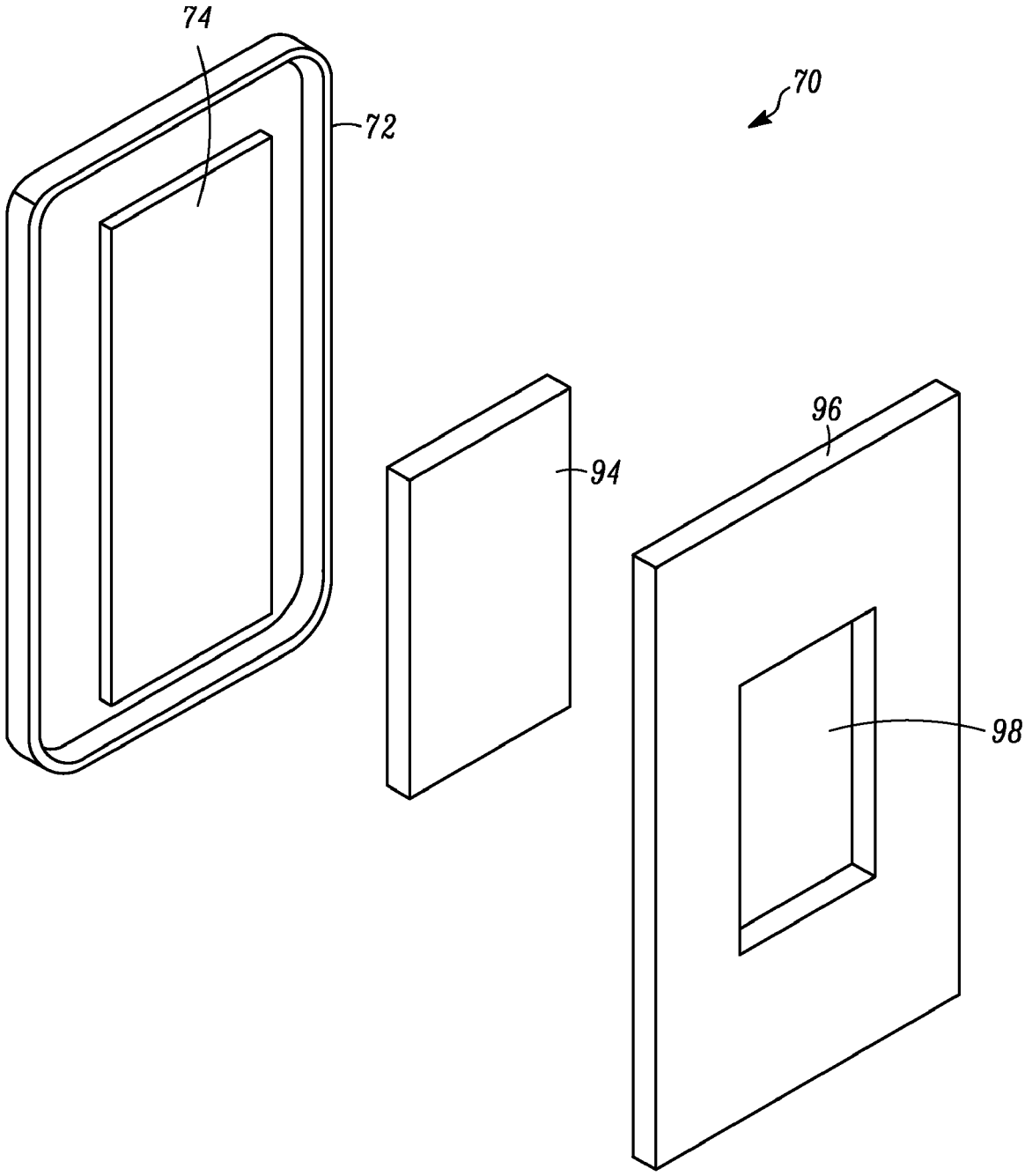
FIG. 3 is an exploded view of the components of a zone controller.

The zone controller 70 of the present invention is directed toward satisfying these objectives. An exploded view of components of a zone controller 70 is shown in FIG. 3. In one embodiment, the zone controller 70 includes a base 72 that is configured for attachment to a wall or other structure. Attached to the base 72 is an electronics board 74, where the electronics board 74 has a plurality of electronic components attached to it. These electronic components are configured to perform the desired zone control functions, including receiving signals from a plurality of thermostats, transmitting control signals to a conditioning unit, and transmitting control signals to a plurality of dampers or valves. The electronic components may also be configured to perform additional functions. A first cover 94 that attaches to the electronics board or base or both is provided to cover a portion of the electronics board 74 and associated electronic components. The first cover 94 is configured to cover the electronic components that are part of the zone controller 70 but that do not need to be accessed by the installer during installation or by the owner or occupant during operation. First cover 94 helps to prevent confusion of the installer by covering those components of the zone controller that the installer does not need to access, thereby presenting the installer with a smaller number of electronic components that may need to be accessed during installation. The first cover 94 also prevents the electronic components underneath it from being damaged during the installation. A second cover 96 is also provided to cover the electronic components that the installer accesses during installation, thereby preventing access to these electronic components when cover 96 is in place, while retaining access to those electronic components that the building owner or occupant needs to access, either to determine the system status or to select an operating characteristic of the zone controller. The second cover 96 helps to prevent the building owner or occupant from making inappropriate adjustments to the electronic components of zone controller 70, and also gives a simplified presentation of the electronic components that may need to be accessed for normal operation. In the embodiment of FIG. 3, the second cover 96 includes an opening 98 for providing access to the operation components.

Figure 4:
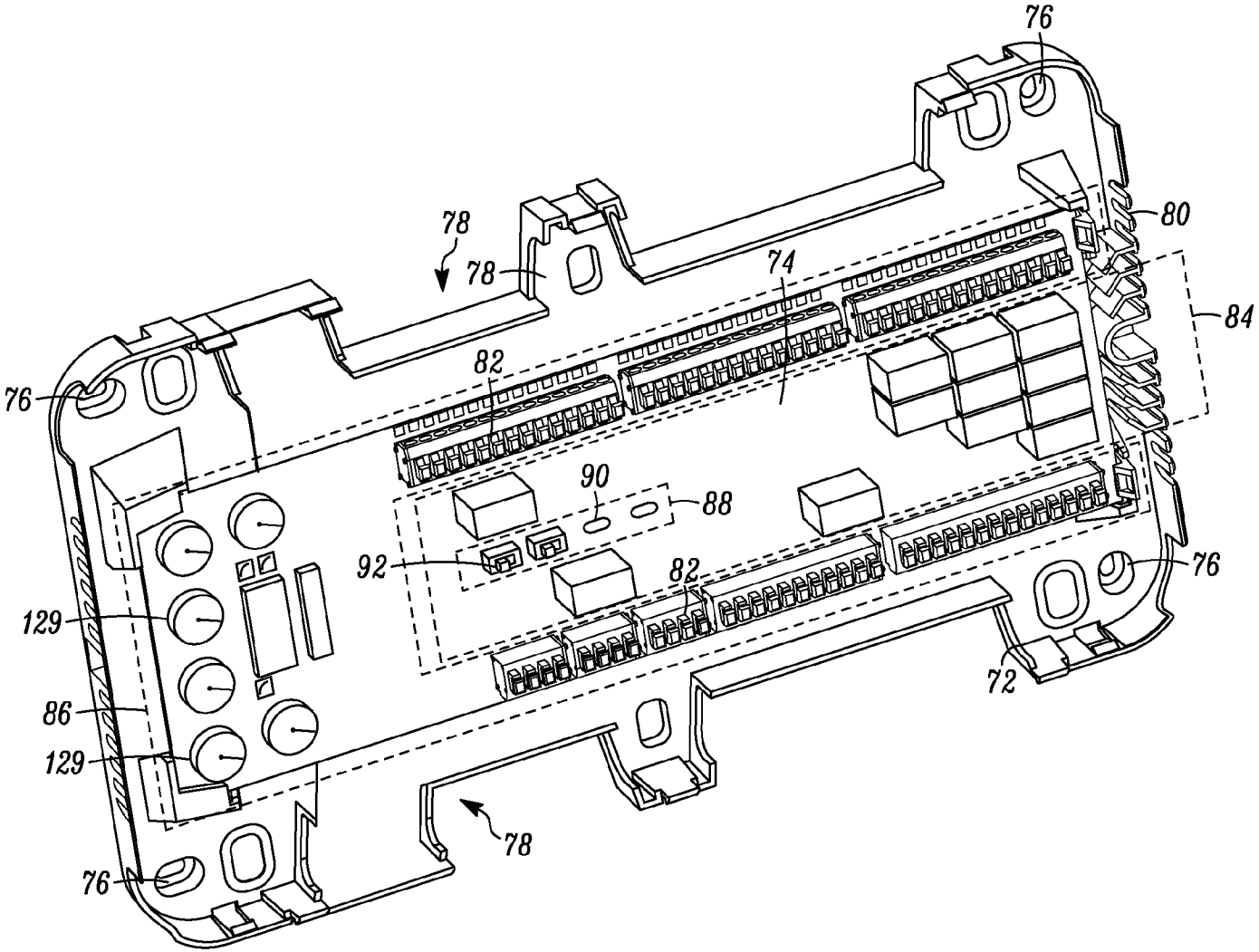
FIG. 4 is a perspective view of a base, electronic board, and other components of a zone controller.

A perspective view of components of one embodiment of a zone controller 70 constructed according to principles of the present invention is shown in FIG. 4. FIG. 4 shows a base 72 and electronics board 74. Base 72 is configured to be attached to a wall or other structure by way of a plurality of fastener holes 76. In the embodiment of FIG. 4, base 72 defines a wire channel 78 that provides clearance for wires and some support for wires, and also includes a plurality of vent openings 80 to provide for air and heat transfer. Base 72 is configured to receive board 74. Board 74 includes the electronic components required to achieve the intended functionality of zone controller 70. For example, board 74 includes wire terminals 82 that are configured to connect wires to the circuitry of zone controller 70. Board 74 also includes other electronic components, such as processors, relays, switches, etc. The electronic components of board 74 can generally be grouped together based on their function. A first grouping of electronic components 84 consists of electronic components that do not need to be accessed by the installer during installation or by the owner or occupant during operation. For example, these electronic components include an input processing component, a microprocessor, a damper driver which powers the movement of one or more duct dampers, and any other associated electronic circuitry. However, the first grouping of components 84 may also include other electronic components that do not need to be accessed by the installer during installation. A second grouping of electronic components 86 consists of electronic components that are typically accessed by the installer during installation, but not by the owner or occupant during operation. For example, these electronic components include wire terminals 82, interface 128, and any other associated electronic components such as dip switches. In the embodiment of FIG. 4, interface 128 includes various switches and dials 129 for providing input. A third grouping of electronic components 88 consists of electronic components that may be accessed by the installer during installation and are typically available to be accessed by the owner or occupant during operation. For example, these electronic components include a plurality of indicators such as LED indicator 90 that provides an indication of a condition, such as an indication of the status of a feature of zone controller 70. For example, LED indicator 90 may indicate that the unit is receiving power, or may indicate whether a zone is calling for conditioning. Third grouping 88 may also include switches or controls for selecting an operating condition of the zone controller 70. For example, grouping 88 may include a switch 92 that is used to select an unoccupied mode where the zone controller 70 operates like a non-zoned system having only a single thermostat or may be used to call for additional emergency heat.

Figure 5:
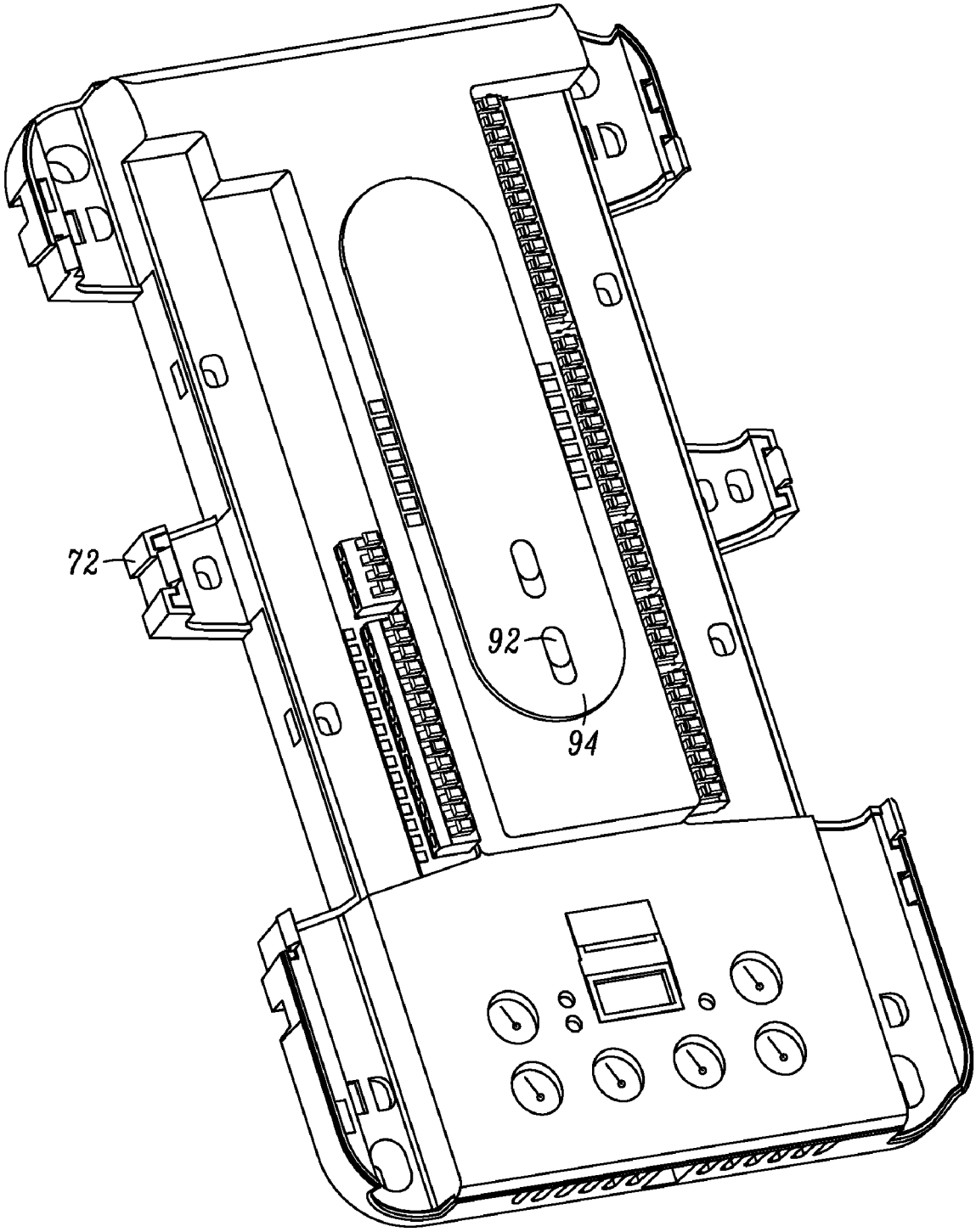
FIG. 5 is a perspective view of a zone controller having a first cover.

Zone controller 70 has a first cover 94 configured to cover the first grouping of electronic components 84. FIG. 5 is a perspective view showing first cover 94. First cover 94 is configured to attach to either board 74 or base 72 or both without being readily removable. In one embodiment, first cover 94 being not readily removable involves being permanently or irreversibly attached to board 74 or base 72, such that first cover 94 can only be removed by breaking or damaging a component. For example, first cover 94 may be attached to board 74 or base 72 by adhesive or by thermal bonding. In another embodiment, first cover 94 being not readily removable involves being reversibly attached to board 74 or base 72, where a tool is required to release first cover 94 from board 74 or base 72. For example, fasteners such as bolts or screws may be used to attach first cover 94. In yet another embodiment, first cover 94 is reversibly attached to board 74 or base 72 but requires substantial or detailed manipulation of a feature to cause a separation. Substantial or detailed manipulation generally requires either that multiple manipulation motions be made simultaneously, that features be manipulated that are not marked or prominent or intuitive, or that the required manipulation forces to effect separation are greater than would be expected for a casual or customary manipulation. For example, separating first cover 94 from board 74 or base 72 may require pressing locking tabs on a side surface of first cover 94 to a released position while pulling on cover 94. By way of further example, separating first cover 94 from board 74 or base 72 may require pulling on first cover 94 with a force greater than would be expected for a casual or customary manipulation, in a way that a reasonable person would recognize the required force to be an indication that cover 94 is not intended to be removed in normal situations. Other embodiments are also usable.

First cover 94 does not cover the second grouping of electronic components 86, thereby allowing the installer to access the electronic components that are related to the installation but not the components that are not related to the installation. Alternatively, first cover 94 provides an opening or other means of accessing the second grouping of electronic components 86. Cover 94 may cover or partially cover any electronic components within the third grouping of electronic components 88, but generally does not prevent the third grouping components 88 from being accessed. For example, where the third grouping 88 includes an LED indicator 90, cover 94 has a transparent or translucent portion for allowing the LED indicator 90 to be perceived, in certain embodiments. Also, where the third grouping includes a switch 92, cover 94 partially covers a portion of switch 92, in some embodiments, so long as switch 92 can be actuated as intended.

Figure 6:
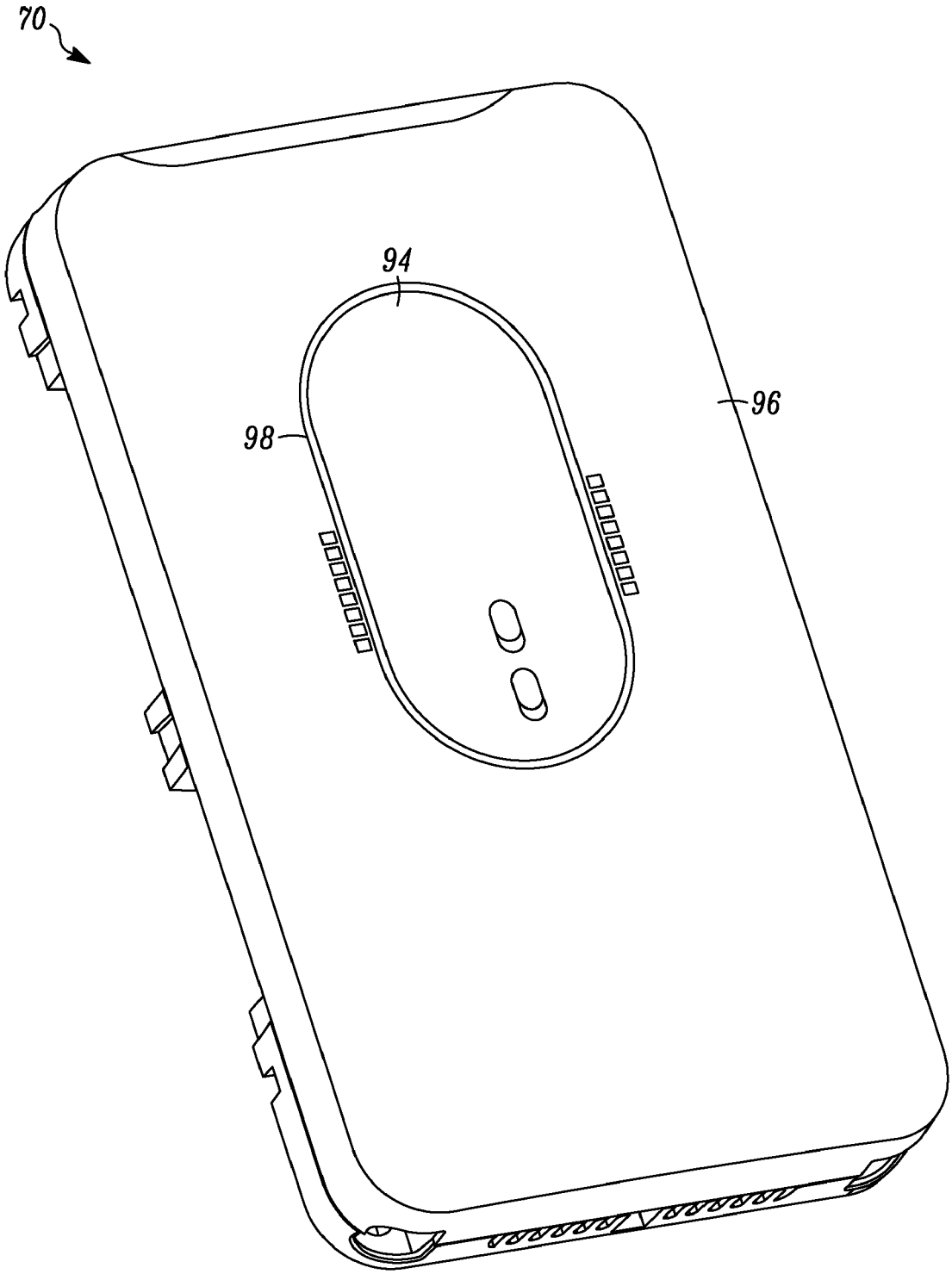
FIG. 6 is a perspective view of a zone controller having a second cover and a first cover.

Zone controller 70 also has a second cover 96 configured to cover the second grouping of electronic components 86. FIG. 6 is a perspective view showing second cover 96. Second cover 96 is configured to attach either to board 74 or base 72 or first cover 94 or any combination thereof. Second cover 96 is configured to be selectively removable from board 74 or base 72. In one embodiment, second cover 96 is selectively removable by virtue of being configured to be removed in a manner that is generally apparent or intuitive. Second cover 96 may also be configured to be removed in a manner that requires a manipulation force level that is consistent with casual or ordinary manipulations. For example, second cover 96 may be configured to be removed by being grasped along an edge or edges and pulling outward with moderate force. As a further example, second cover 96 may be configured as a hinged door that can be grasped and rotated to an open position. Other embodiments are also usable.

Second cover 96 covers the second grouping of electronic components 86, thereby preventing a building owner or occupant from accessing electronic components that should not be accessed or modified without adequate training. Although second cover 96 can be removed if needed, the act of removing the cover provides an indication to an owner or occupant that he or she is accessing components that are intended for more complex functions and are not generally intended for use by people without sufficient training. Second cover 96 also simplifies the presentation of the zone controller 70 to provide a more attractive and orderly appearance. Many embodiments of second cover 96 are usable. In the particular embodiment of FIG. 6, second cover 96 is constructed so that it does not completely cover first cover 94. Alternatively, second cover 96 could be configured to cover first cover 94 while also providing access to the electronic components that are to be accessed by the building owner or occupant. In this case, the electronic components that are to be accessed by the building owner or occupant may be located at a position other than on first cover 94, or through an opening in first cover 94.

Figure 7:
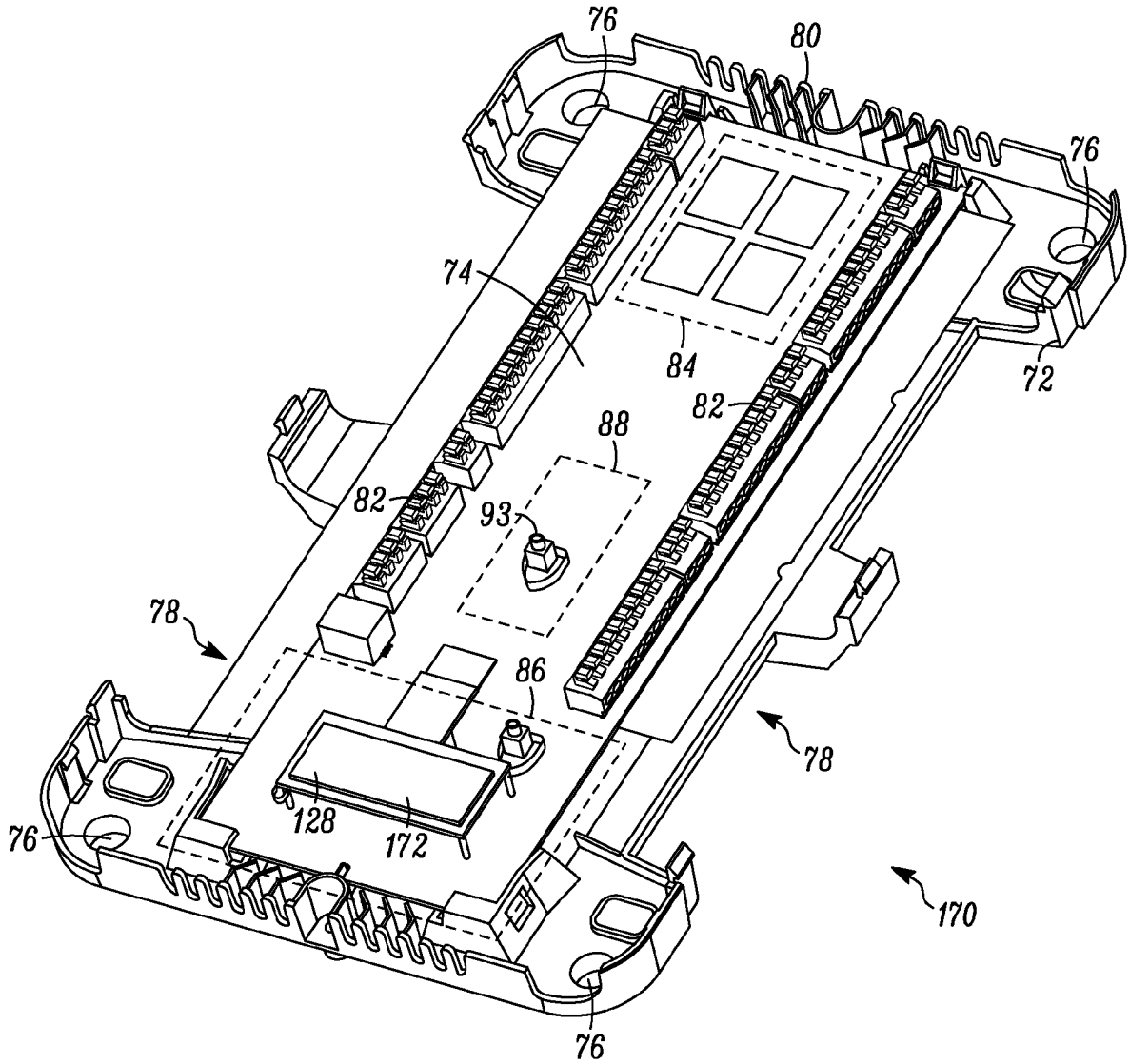
FIG. 7 is a perspective view of an alternative base, electronic board, and other components of a zone controller.
Figure 8:
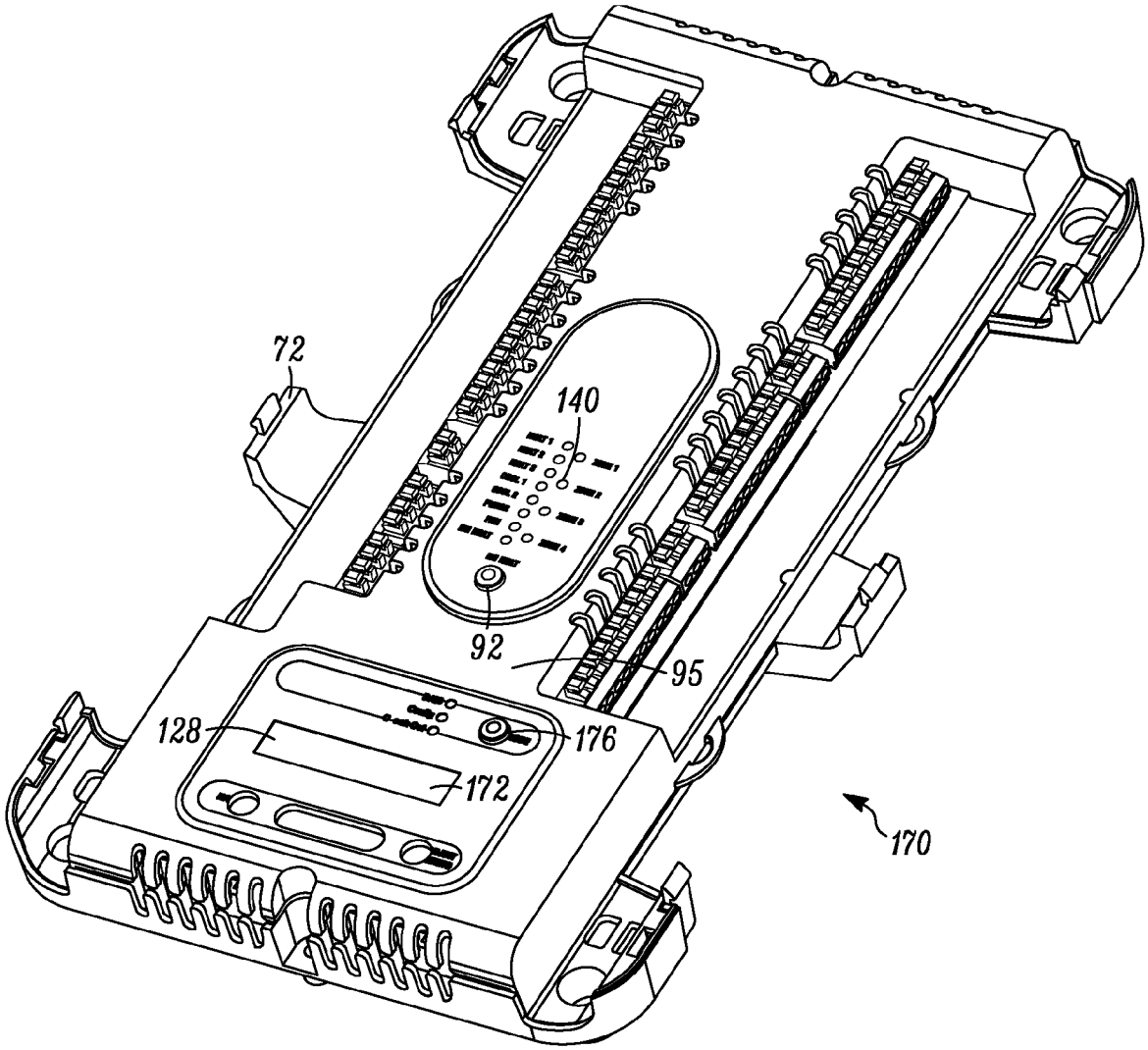
FIG. 8 is a perspective view of an alternative zone controller having a first cover, incorporating the components of FIG. 7.
Figure 9:
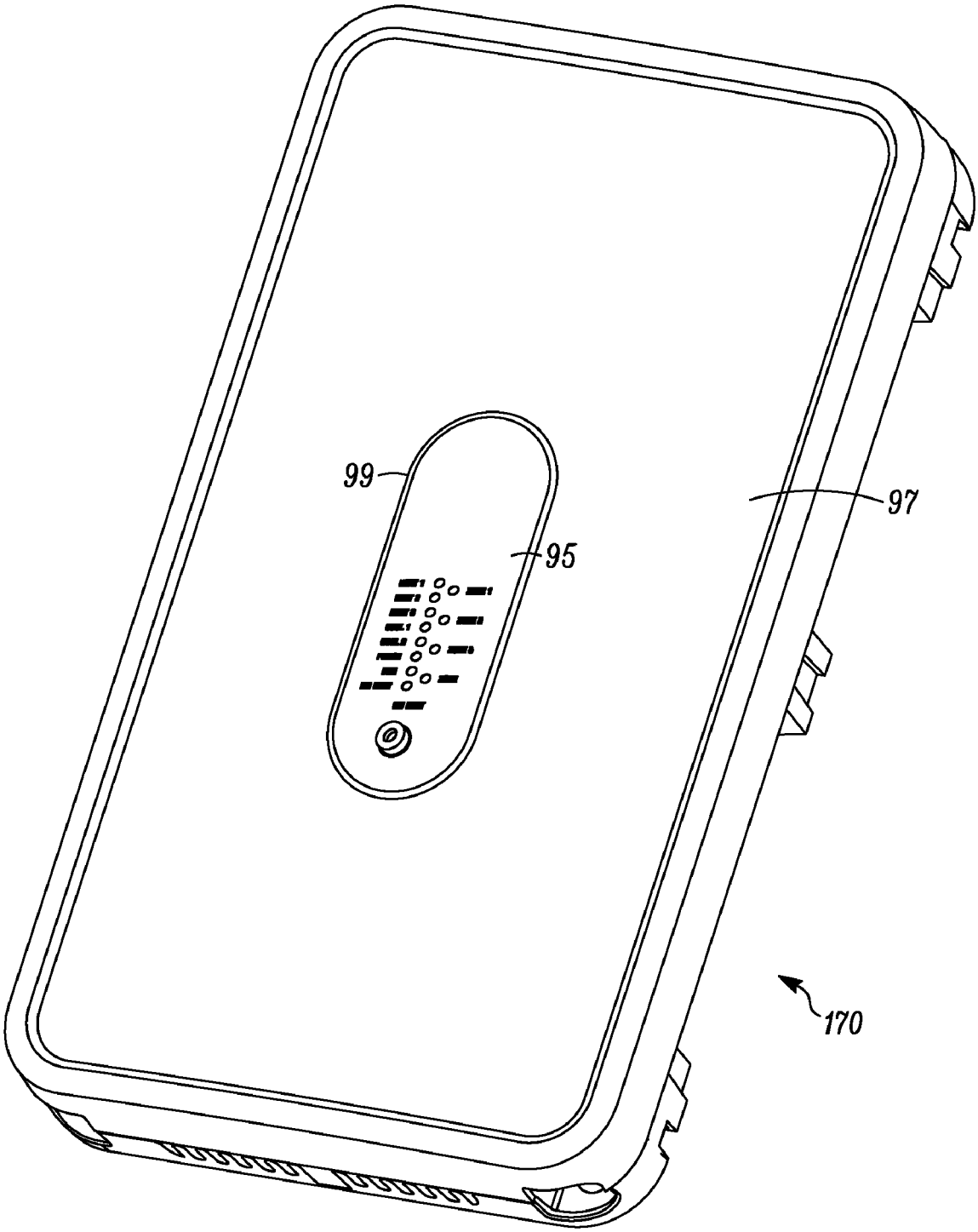
FIG. 9 is a perspective view of an alternative zone controller having a second cover and a first cover, incorporating the components of FIGS. 7 and 8.

An alternative embodiment of a zone controller 170 is shown in FIGS. 7, 8, and 9. The embodiment of FIGS. 7, 8, and 9 is generally similar to the embodiment of FIGS. 4, 5, and 6; however, certain differences will be noted. Zone controller 170 includes a first cover 95 and a second cover 97. In the embodiment of FIG. 7, interface 128 includes an LCD screen 172 for displaying information to an installer. Interface 128 further includes features for allowing an installer to make selections, such as button 176. Grouping 88 includes a switch 93, where switch 93 is used to control the application of emergency heat. In addition, first cover 95 includes a plurality of LED indicators 140, where LED indicators 140 are positioned on first cover 95 and are configured to display operation information, such as the status of each zone. Second cover includes an opening 99 that is configured to allow first cover 95 to be accessible when second cover 97 is installed.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. An HVAC zoning control panel comprising:

(i) an electronics board;

(ii) a plurality of electronic components mounted to the electronics board, the electronic components being characterized by a first grouping of electronic components that are not accessed to perform either installation or operation functions, a second grouping of electronic components that are accessed to perform installation functions, and a third grouping of electronic components that are accessed to perform operation functions, wherein access to the first, second and third groupings of electronic components comprises manual manipulation;

(iii) a first board cover that prevents access to the first grouping of electronic components; and (iv) a second board cover that selectively prevents access to the second grouping of electronic components but not the third grouping of electronic components.

2. The zoning control panel of claim 1, further comprising a base, where the first board cover is configured to attach to the base.

3. The zoning control panel of claim 1, further comprising a base, where the second board cover is configured to attach to the base.

4. The zoning control panel of claim 1, wherein the second board cover does not prevent access to at least a portion of the first board cover.

5. The zoning control panel of claim 4, wherein the third grouping of electronic components are accessible through the first board cover.

6. The zoning control panel of claim 1, wherein the first board cover and second board cover together cover the entire electronics board.

7. The zoning control panel of claim 1, wherein the first board cover is not readily removable.

8. An HVAC zoning control panel comprising:

(i) an electronic board;

(ii) a plurality of electronic components mounted to the electronics board, the electronic components comprising (a) electrical components configured to receive a plurality of signals from a plurality of thermostats;

(b) electrical components configured to transmit a plurality of signals to a plurality of dampers within air ducts;

(c) electrical components configured to transmit signals to a conditioning unit for modifying the temperature of air within air ducts;

(d) electrical components configured to provide an interface for selecting operating parameters;

(e) electrical components configured to provide an indication of a condition; and (f) a microprocessor configured to control the transmission of signals to the dampers and conditioning unit in response to the signals received from the thermostats and parameters selected through the interface;

(iii) the electronic components including a first grouping of electronic components that are not accessed to perform either installation or operation functions, a second grouping of electronic components that are accessed to perform installation functions, and a third grouping of electronic components that are accessed to perform operation functions, wherein access to the first, second and third groupings of electronic components comprises manual manipulation;

(iv) a first board cover that prevents access to the first grouping of electronic components; and (v) a second board cover that selectively prevents access to the second grouping of electronic components but not the third grouping of electronic components.

9. The zoning control panel of claim 8, further comprising a base, where the second board cover is configured to attach to the base.

10. The zoning control panel of claim 8, wherein the second board cover does not prevent access to the first board cover.

11. The zoning control panel of claim 8, wherein the first board cover is not readily removable.

12. The zoning control panel of claim 8, wherein the plurality of electrical components further includes a damper driver, and wherein the first grouping of electronic components comprises a damper driver.

13. The zoning control panel of claim 8, wherein the first grouping of electrical components comprises electrical components configured to receive a plurality of signals from a plurality of thermostats, electrical components configured to transmit a plurality of signals to a plurality of dampers within air ducts, electrical components configured to transmit control signals to a conditioning unit for modifying the temperature of air within air ducts, and a microprocessor.

14. The zoning control panel of claim 8, wherein the second grouping of electrical components comprises electrical components configured to provide an interface for selecting operating parameters.

15. The zoning control panel of claim 8, wherein the third grouping of electrical components comprises electrical components configured to provide an indication of a condition.

16. A method for operating an HVAC zoning control panel, the method comprising:

providing an electronics board having first, second, and third groupings of electronic components disposed thereon;

providing a first board cover that prevents access to the first grouping of electronic components of the electronics board of the HVAC zoning control panel, wherein the first grouping of electronic components are not accessed to perform either installation or operation functions;

providing a second board cover that prevents access to the second grouping of electronic components but not the third grouping of electronic components of the electronics board of the HVAC zoning control panel, wherein the second grouping of electronic components are accessed to perform installation functions, and wherein the third grouping of electronic components are accessed to perform operation functions;

performing operation functions for the HVAC zoning control panel by accessing the third grouping of electronic components with both the first board cover and the second board cover installed; and performing installation functions for the HVAC zoning control panel by selectively removing the second board cover but not the first board cover to provide access to the second grouping of electronic components.

17. The zoning control panel of claim 1, wherein the second board cover does not prevent access to at least a portion of the first board cover.

18. The zoning control panel of claim 1, wherein the second board cover includes an opening that allows access to at least a portion of the third grouping of electronic components.

19. The zoning control panel of claim 1, wherein the first cover, when in place, covers the first grouping of electronic components but provides access to the second grouping of electronic components and the third grouping of electronic components.

20. The zoning control panel of claim 19, wherein the second cover, when in place, covers the second grouping of electronic components but not the third grouping of electronic components, and wherein the second cover covers at least a portion of the first cover.

21. The zoning control panel of claim 1, wherein the second grouping of electronic components includes a plurality of wire terminals that are configured to connect wires to the zoning control panel, wherein the first cover, when in place, covers the first grouping of electronic components but provides access to at least some of the plurality of wire terminals of the second grouping of electronic components.

* * * * *